US009441455B2

(12) United States Patent
O'Malley et al.

(10) Patent No.: US 9,441,455 B2
(45) Date of Patent: Sep. 13, 2016

(54) CEMENT MASKING SYSTEM AND METHOD THEREOF

(71) Applicants: Edward J. O'Malley, Houston, TX (US); Charles C. Johnson, League City, TX (US); James G. King, Kingwood, TX (US)

(72) Inventors: Edward J. O'Malley, Houston, TX (US); Charles C. Johnson, League City, TX (US); James G. King, Kingwood, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 14/039,582

(22) Filed: Sep. 27, 2013

(65) Prior Publication Data

US 2015/0090449 A1 Apr. 2, 2015

(51) Int. Cl.

| | |
|---|---|
| ***E21B 43/26*** | (2006.01) |
| ***E21B 34/06*** | (2006.01) |
| ***E21B 43/114*** | (2006.01) |
| *E21B 34/00* | (2006.01) |

(52) U.S. Cl.

CPC ..... *E21B 34/063* (2013.01); *E21B 43/114* (2013.01); *E21B 43/26* (2013.01); *E21B 2034/007* (2013.01)

(58) Field of Classification Search

CPC ..... E21B 43/26; E21B 43/261; E21B 33/138
See application file for complete search history.

(56) References Cited

U.S. PATENT DOCUMENTS

| | | | | |
|---|---|---|---|---|
| 3,273,641 | A | 9/1966 | Bourne | |
| 5,094,103 | A | 3/1992 | Wicks, III | |
| 5,515,915 | A | 5/1996 | Jones et al. | |
| 6,619,398 | B2 | 9/2003 | MacKenzie et al. | |
| 6,644,406 | B1 * | 11/2003 | Jones | 166/308.1 |
| 6,662,873 | B1 | 12/2003 | Nguyen et al. | |
| 6,755,249 | B2 | 6/2004 | Robison et al. | |
| 6,834,725 | B2 | 12/2004 | Whanger et al. | |
| 7,243,732 | B2 | 7/2007 | Richard | |
| 7,318,481 | B2 | 1/2008 | Richard | |
| 7,392,852 | B2 | 7/2008 | Richard | |
| 7,578,347 | B2 | 8/2009 | Bosma | |
| 7,690,437 | B2 | 4/2010 | Guillot et al. | |
| 7,784,532 | B2 | 8/2010 | Sevre et al. | |
| 7,866,393 | B2 | 1/2011 | Badalamenti et al. | |
| 8,104,538 | B2 | 1/2012 | Richard et al. | |
| 8,967,276 | B2 | 3/2015 | Mazyar et al. | |

(Continued)

FOREIGN PATENT DOCUMENTS

| | | | |
|---|---|---|---|
| AU | 2011218707 | A1 | 9/2011 |
| WO | 2011131306 | A1 | 10/2011 |

(Continued)

OTHER PUBLICATIONS

"FracPoint MP Sleeve with DirectConnect Ports"; Baker Hughes Incorporated; Trade Show Material, 2012; 4 pages.

(Continued)

*Primary Examiner* — Doug Hutton, Jr.
*Assistant Examiner* — Silvana Runyan
(74) *Attorney, Agent, or Firm* — Cantor Colburn LLP

(57) ABSTRACT

A cement masking system includes a tubular having a wall with at least one radial port. At least one swellable member is arranged to cover the at least one port. The at least one swellable member is configured to at least partially displace cement radially of the tubular during radial expansion of the at least one swellable member. A method of masking ports in a tubular from cement employs the cement masking system.

22 Claims, 5 Drawing Sheets

(56) References Cited

U.S. PATENT DOCUMENTS

| | | | | |
|---|---|---|---|---|
| 2003/0070811 | A1 | 4/2003 | Robison et al. | |
| 2004/0168804 | A1 | 9/2004 | Reddy | |
| 2005/0205263 | A1 | 9/2005 | Richard | |
| 2006/0000617 | A1* | 1/2006 | Harrall et al. | 166/380 |
| 2006/0048939 | A1 | 3/2006 | Johnson | |
| 2006/0124310 | A1* | 6/2006 | Lopez de Cardenas et al. | 166/313 |
| 2006/0207765 | A1 | 9/2006 | Hofman et al. | |
| 2008/0210423 | A1 | 9/2008 | Boney | |
| 2008/0289823 | A1 | 11/2008 | Willberg et al. | |
| 2009/0014168 | A1* | 1/2009 | Tips et al. | 166/73 |
| 2009/0188569 | A1 | 7/2009 | Saltel | |
| 2010/0096119 | A1* | 4/2010 | Sevre et al. | 166/51 |
| 2010/0230103 | A1 | 9/2010 | Parker | |
| 2010/0300689 | A1 | 12/2010 | McRobb et al. | |
| 2010/0314111 | A1 | 12/2010 | Karcher | |
| 2011/0077324 | A1 | 3/2011 | Ravi | |
| 2011/0135953 | A1 | 6/2011 | Xu | |
| 2011/0220359 | A1 | 9/2011 | Soliman et al. | |
| 2011/0220362 | A1 | 9/2011 | Huang | |
| 2011/0226479 | A1 | 9/2011 | Tippel et al. | |
| 2011/0284229 | A1* | 11/2011 | Radmanovich et al. | 166/308.1 |
| 2012/0048551 | A1* | 3/2012 | Allison et al. | 166/292 |
| 2012/0073819 | A1 | 3/2012 | Richard et al. | |
| 2012/0175134 | A1 | 7/2012 | Robisson et al. | |
| 2012/0261127 | A1 | 10/2012 | Zhou | |
| 2013/0140043 | A1 | 6/2013 | Swanson et al. | |
| 2013/0180725 | A1 | 7/2013 | Richard et al. | |
| 2013/0199843 | A1 | 8/2013 | Ross | |
| 2013/0220635 | A1* | 8/2013 | Greci et al. | 166/380 |
| 2014/0110119 | A1* | 4/2014 | Luyster et al. | 166/305.1 |
| 2015/0027709 | A1 | 1/2015 | Richard et al. | |
| 2015/0090448 | A1 | 4/2015 | O'Malley et al. | |

FOREIGN PATENT DOCUMENTS

| | | | |
|---|---|---|---|
| WO | 2011131307 | A1 | 10/2011 |
| WO | WO2013109408 | A1 | 7/2013 |

OTHER PUBLICATIONS

A.S. Metcalf et al., "Case Histories of Successful Acid Stimulation of Carbonate Completed With Horizontal Open Hole Wellbores"; Journal of Canadian Petroleum Technology, vol. 48, No. 6; Jun. 2006, 5 pages.

Brooks et al. "Use of Swellable Elastomers to Enhance Cementation in Deep Water Applications" Deep Offshore Technology Conference—International in Houston, TX, Feb. 12-14, 2008, pp. 13.

International Search Report and the Written Opinion of the International Searching Authority; PCT/US2014/044505; Oct. 27, 2014, 5 pages.

International Search Report and the Written Opinion of the International Searching Authority; PCT/US2014/050635; Mailed Nov. 28, 2014; 13 pages.

Miller et al., Unlocking Tight Oil: Selective Multi-Stage Fracturing in the BakkenShale, Whiting Petroleum Corporation, Baker Hughes, Sep. 21-24, 2008, SPE International 116105-MS, pp. 1-6.

Notification of Transmittal of the International Search Report and Written Opinion of the International Searching Authority, or the Declaration; PCT/US2013/020049; Apr. 10, 2013, 9 pages.

PCT International Search Report and the Written Opinion of the International Searching Authority; PCT/US2014/050638; Nov. 21, 2014, 15 pages.

* cited by examiner

CEMENT MASKING SYSTEM AND METHOD THEREOF

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. A tubular inserted within the borehole is used for allowing the natural resources to flow within the tubular to a surface or other location, or alternatively to inject fluids from the surface to the borehole. Opening perforations through the wall of the tubular to allow fluid flow there through after deployment of the tubular within the borehole is not uncommon. One method of opening such perforations is through ignition of ballistic devices, referred to as perforation guns. Due to the explosive nature of the guns, the art would be receptive to alternate methods of opening perforations in tubulars that do not require guns.

SUMMARY

A cement masking system includes a tubular having a wall with at least one radial port; at least one swellable member arranged to cover the at least one port, the at least one swellable member configured to at least partially displace cement radially of the tubular during radial expansion of the at least one swellable member.

A method of masking ports in a tubular from cement, the method includes covering the ports by at least one swellable member; inserting the tubular within a borehole; cementing an annular space between the tubular and the borehole; allowing the swellable member to expand from liquid and, at least partially displacing the cement with the swellable member.

A cement masking system including a tubular having a wall with at least one radial port; at least one radially extendable member arranged to cover the at least one port, the at least one radially extendable member configured to at least partially displace cement radially of the tubular during radial expansion of the at least one radially extendable member; and, at least one shunt tube configured to allow passage of cement past the at least one radially extendable member

BRIEF DESCRIPTION OF THE DRAWINGS

Referring now to the drawings wherein like elements are numbered alike in the several Figures.

DETAILED DESCRIPTION

A detailed description of one or more embodiments of the disclosed apparatus and method are presented herein by way of exemplification and not limitation with reference to the Figures.

Figure 5:
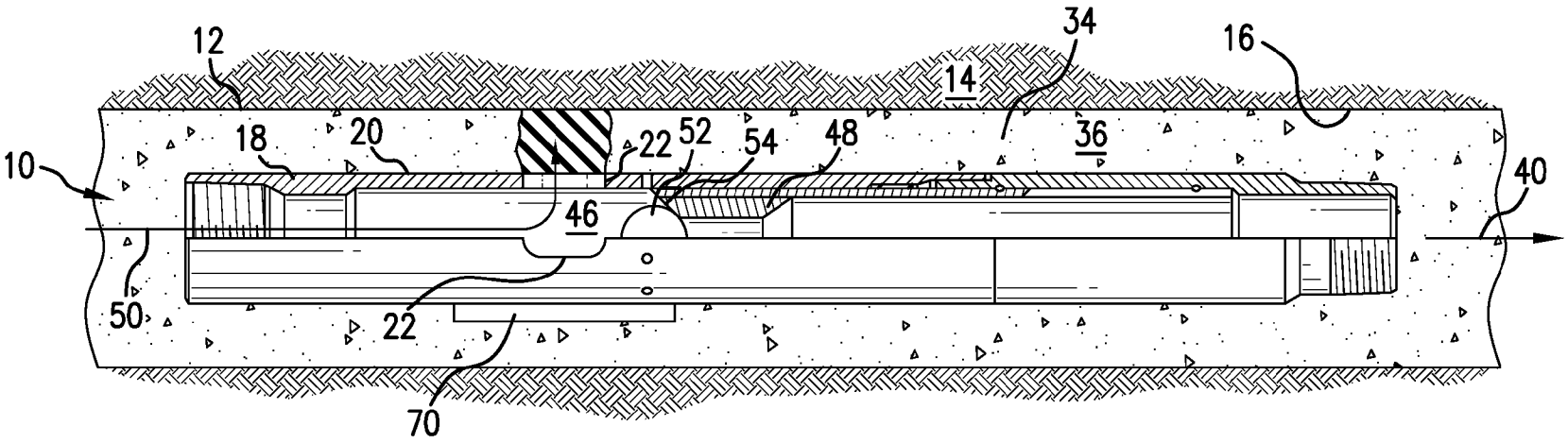
FIG. 5 is a partial quarter cross-sectional view of the downhole system of FIG. 1 with a sleeve shifted.
Figure 6:
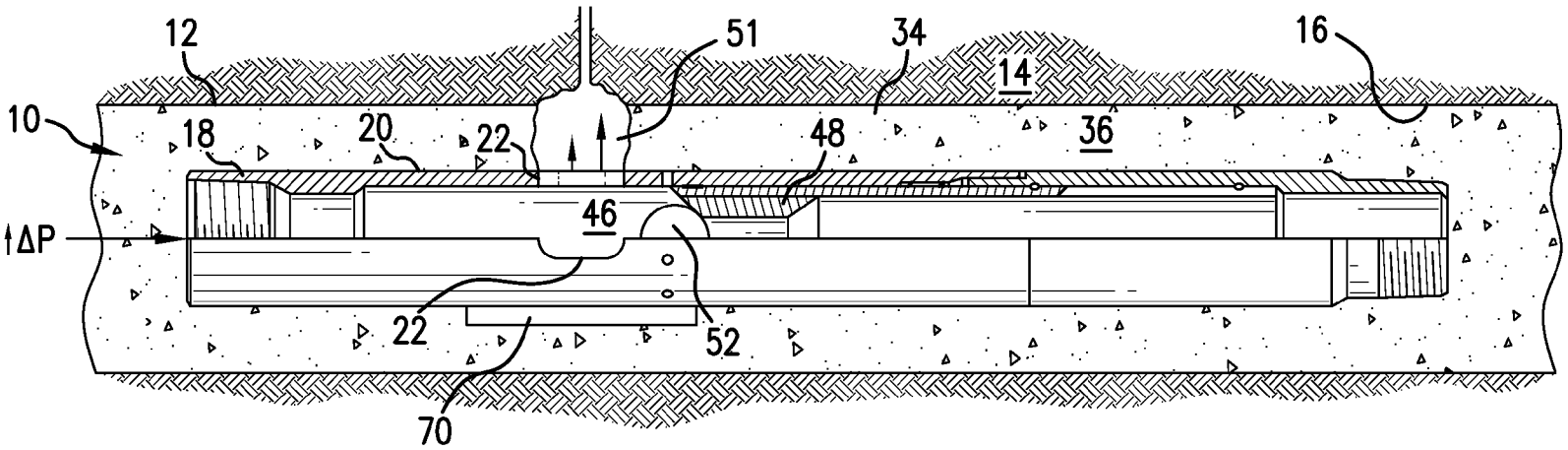
FIG. 6 is a partial quarter cross-sectional view of the downhole system of FIG. 1 with the radially extendable member removed and a fracture procedure initiated.
Figure 7:
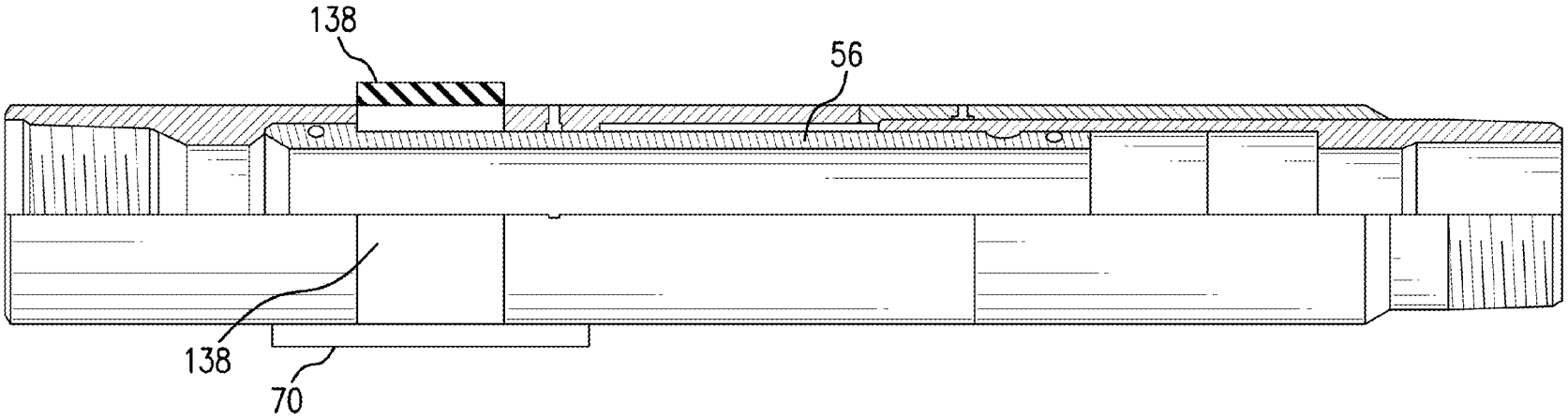
FIG. 7 is a partial quarter cross-sectional view of another exemplary embodiment of a downhole system with a radially extendable member in a non-extended condition; and, FIG. 8 is a cross-sectional view of an exemplary embodiment of a tubular, shunt tubes, and radially extendable member for the downhole system.
Figure 8:
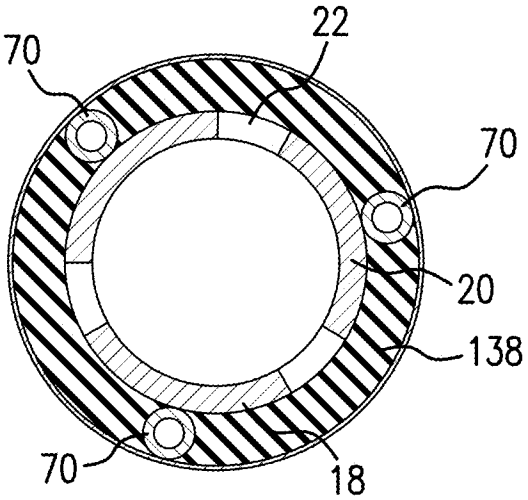

Referring to FIGS. 1-6, an exemplary embodiment of a downhole system 10 is illustrated. The system 10 is a non-ballistic tubular perforating system employable as a completion system within a borehole 12 extending through a formation 14. The system 10 is particularly well-suited for use in a horizontal well, although its application in other wells is not restricted. The borehole 12 has a wall 16 that may be fractured to enhance the extraction of natural resources from the formation 14. The system 10 includes a tubular 18 having a wall 20 with flow ports 22 there through. While only one section 24 of the tubular 18 is illustrated, it should be understood that several zones within the borehole 12 may be operated thereon using the system 10 by connecting the section 24 of the tubular 18 to other sections 24, such as by using the threaded connections 26, 28 shown at the uphole and downhole ends 30, 32, respectively, of the section 24, or by connecting the section 24 to other sections 24 with other pieces of tubular (not shown) positioned there between. Cement 34 (shown in FIGS. 2-6 only) is positionable radially of the tubular 18 in an annular space 36 between the wall 20 of the tubular 18 and the wall 16 of the borehole 12, as will be further described below. At least one radially extendable member 38 is positioned radially outwardly of the tubular 18 in locations covering the ports 22. As illustrated, the ports 22 are elongated apertures in the wall 20 that that are radially distributed about the tubular 18, although other shapes and arrangements of the ports 22 may also be included in the system 10. Additionally, any number of the ports 22 may be included through the wall 20 of the tubular 18. For operating within different longitudinally spaced zones of the borehole 12, longitudinally spaced ports 22 can be provided, such as by the interconnection of two or more of the sections 24 of the tubular 18. The member 38 can be provided at discrete locations to block each individual port 22, or, as shown in FIGS. 7 and 8, a single member 138 can wrap around the outer periphery of the tubular 18 to cover several ports 22, such as all the ports 22 within a particular section 24 of the tubular 18. The members 38 may be provided entirely or partially within each port 22, or positioned radially exteriorly of the ports 22. The members 38 can also cover the peripheries of their associated ports 22.

The radially extendable member 38 is a swell elastomer that can increase radially while surrounding the ports 22 of the tubular 18. A swell elastomer is achieved by blending a super absorbent polymer into a base elastomer compound. When the swell elastomer is exposed to liquid, such as, but not limited to water, cement (which contains water), and/or oil, the liquid is absorbed in the polymer in the swell elastomer and the swell elastomer volume increases. The swell elastomer is used as a volumetric masking agent to substantially limit the amount of cement 34 delivered to certain areas within the borehole 12, in particular the areas in the radial vicinity of the ports 22.

Figure 1:
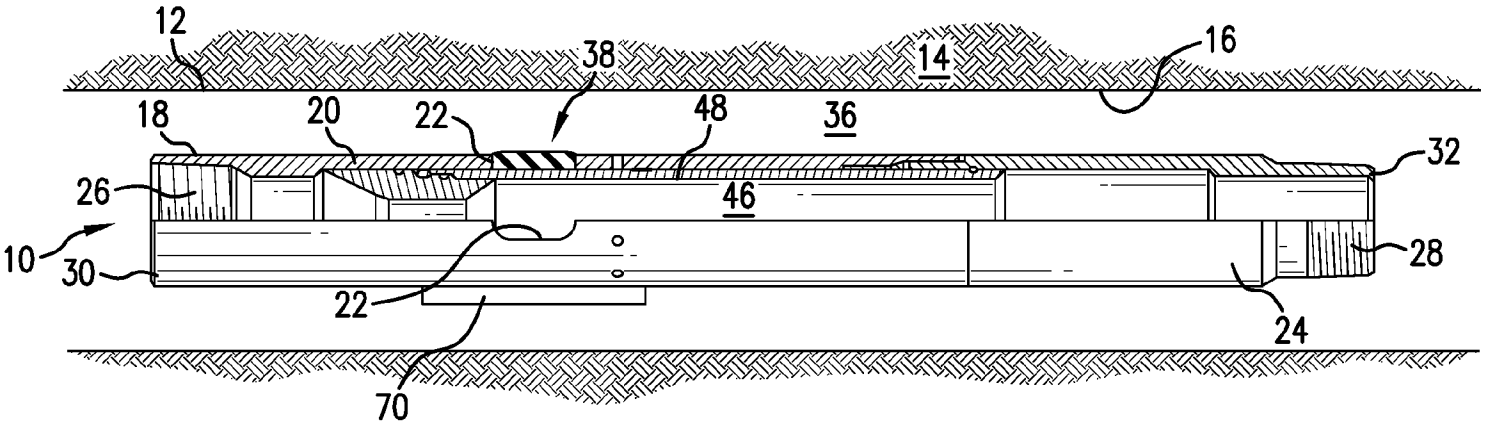
FIG. 1 is a partial quarter cross-sectional view of an exemplary embodiment of a downhole system with a radially extendable member in a non-extended condition.

With reference to FIG. 1, the members 38 are initially provided in a non-swelled state on the outer diameter of the tubular 18. The members 38 are mounted on the outer diameter, or partially or fully within the ports 22, in such a way that they surround, enclose, or fill at least the perimeter and area of the flow ports 22. The members 38 are engineered such that they will remain at least substantially non-swelled during deployment of the system 10, as swelled members 38 would clearly impede delivery of the tubular 18 into the borehole 12. FIG. 1 shows the system 10 with the members 38 in the non-swelled state during initial run-in in the borehole 12. The members 38 will begin to deploy to the swelled shape substantially surrounding/enclosing the flow ports 22 of the system 10 upon exposure to liquid, such as that provided by cement 34, or by other liquids naturally residing or otherwise provided in the annular space 36.

Figure 2:
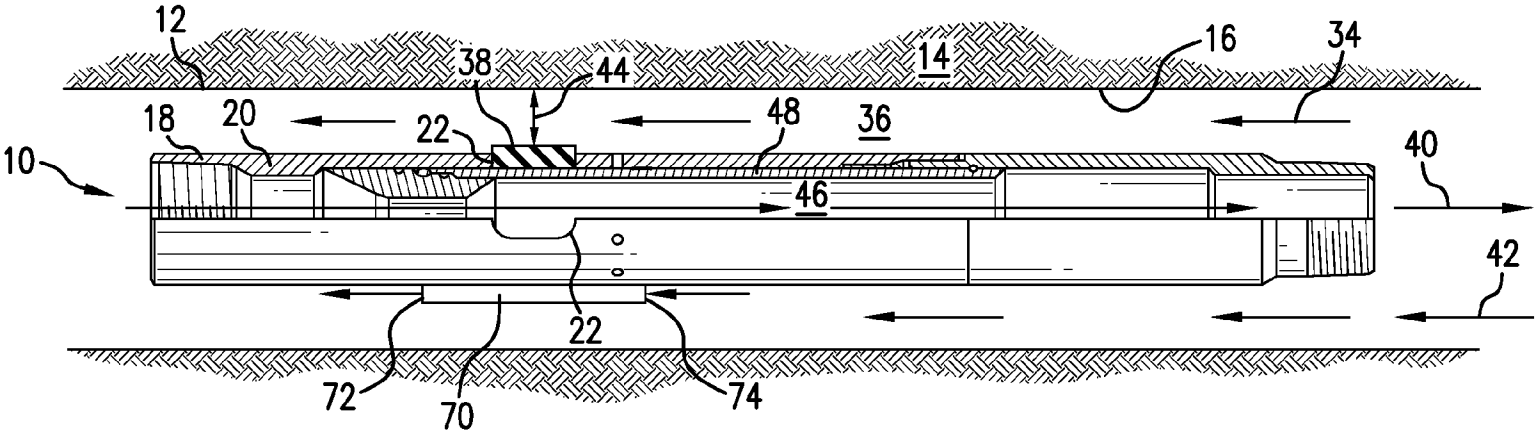
FIG. 2 is a partial quarter cross-sectional view of the downhole system of FIG. 1 depicting a cementing operation.

The introduction of cement 34 is shown in FIG. 2. The cement 34 is pumped in a downhole direction 40 through the tubular 18. At an end of the tubular 18 (or through downhole ports in the tubular 18, not shown), after the cement 34 escapes the tubular 18, the cement 34 moves in an uphole direction 42 through the annular space 36 between the tubular 18 and the borehole wall 16. Radially extending the radially extendable member 38 after the cement 34 is pumped allows the cement 34 to be pumped through the annular clearance 44 between the wall 16 of the borehole 12 and the radially extendable member 38. However, shunt tubes 70 are additionally provided on the tubular 18 to allow the cement 34 to travel there through, and are positioned radially inward of at least portions of the radially extendable member 38. In addition to providing an extra path for the cement, if the radially extendable member 38 has swelled to the point of reaching the inner diameter of the borehole 16, then the shunt tubes 70 provide a necessary pathway for the cement. The shunt tubes 70 have a longitudinal length longer than that of the radially extendable member 38 to prevent the radially extended radially extendable member 38 from potentially enclosing and blocking the uphole and downhole openings 72, 74 of the shunt tubes 70. Any number of shunt tubes 70 may be radially distributed about the tubular wall 20, and may be rigidly secured thereto. Alternatively, the shunt tubes 70 may be embedded within the radially extendable member 38 in its un-swelled state prior to securing the radially extendable member 38 and shunt tubes 70 onto the tubular. The illustrated embodiment shown in FIG. 8 depicts three substantially evenly spaced shunt tubes 70 radially distributed about the outer periphery of the tubular 18. Also depicted in FIG. 8, each shunt tube 70 is positioned between a pair of radially adjacent ports 22, however it should be understood that the embodiment shown in FIG. 8 is illustrative only and any number and relative arrangement of shunt tubes 70 and ports 22 can be provided on the tubular 18 to suit the purposes of particular downhole operations.

Figure 3:
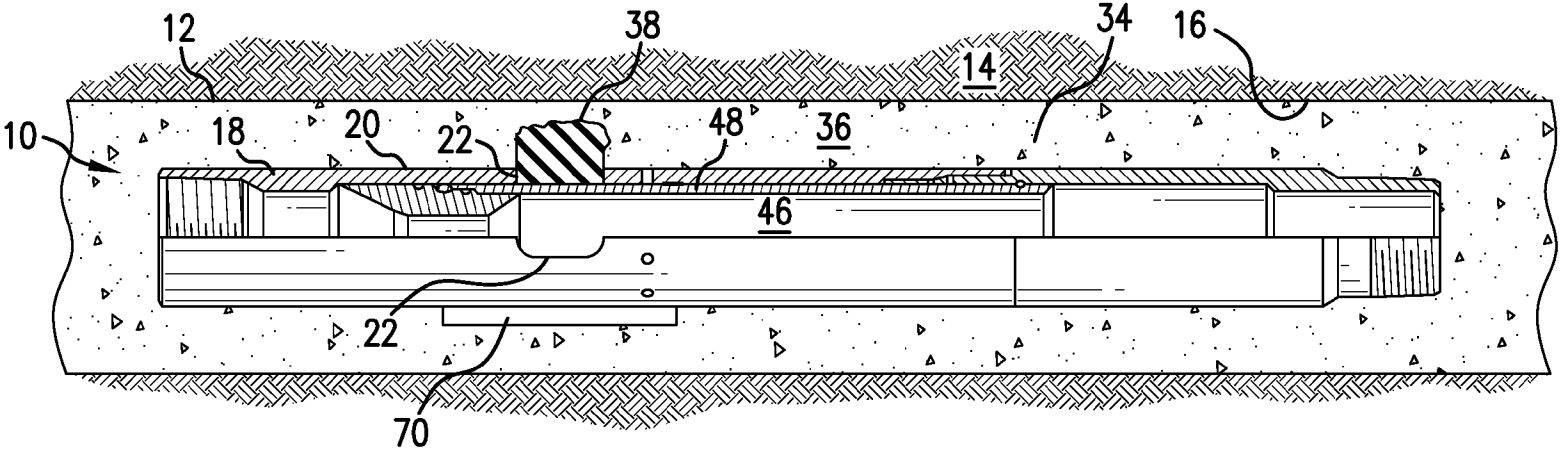
FIG. 3 is a partial quarter cross-sectional view of the downhole system of FIG. 1 with the radially extendable member in a partially extended condition.
Figure 4:
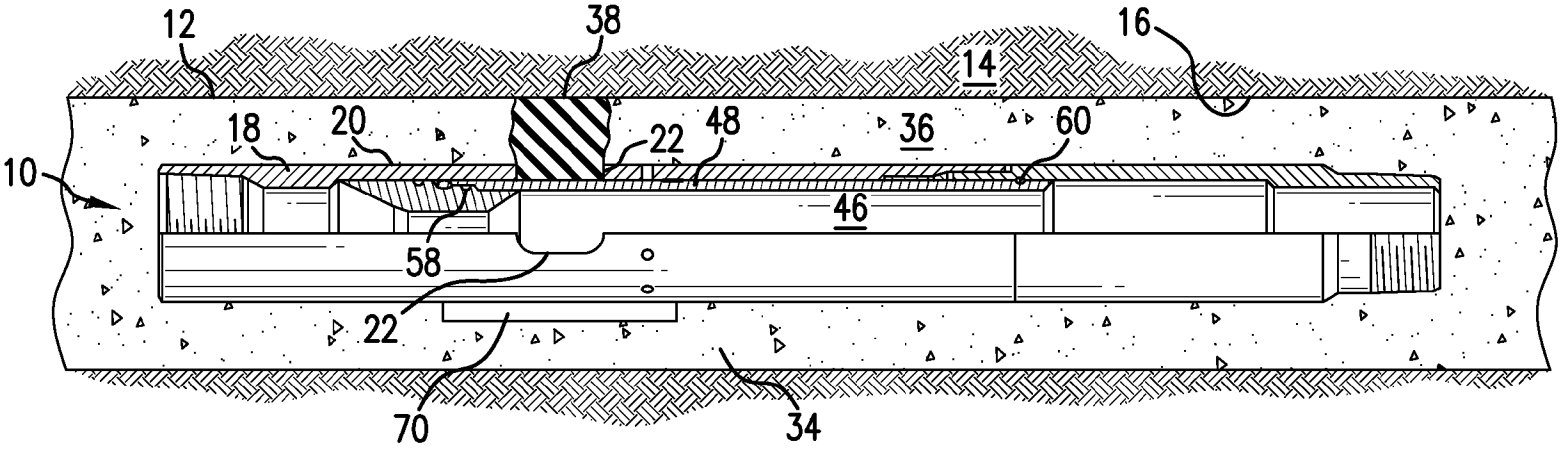
FIG. 4 is a partial quarter cross-sectional view of the downhole system of FIG. 1 with the radially extendable member in a fully extended condition.

The radial extension of the radially extendable member 38 displaces some more of the cement 34 as the radially extendable member 38 radially extends into contact with the wall 16. While a radial extension is disclosed, it is possible for the radially extendable member 38 to also longitudinally expand in uphole and downhole directions, and therefore the shunt length is chosen as described above so as not to be obstructed by the radially extendable member 38 when expanded. The members 38 will deploy to the swelled state substantially surrounding/enclosing the flow ports 22 of the system 10 upon exposure to liquid (such as that found in the green cement 34, cement that has not yet cured). This is shown in FIG. 3, with the members 38 being deployed and displacing the green cement 34. The swelling of the members 38 will extend from the outer diameter of the tubular 18 out to the inner diameter of the borehole wall 16, and contact and conform to this wall 16, as shown in FIG. 4. As the member 38 expands in volume, the member 38 displaces uncured cement 34 from the area into which it deploys, which is at least radially from the outer diameter of the tubular wall 20 to the inner diameter of the borehole wall 16. The displacement of the uncured cement 34 may be complete, or may include only enough liquid and particulate to severely degrade the quality of any cement 34 remaining in the area, such as between the outer diameter of the member 38 and the inner diameter of the wall 16, once cured. If necessary the cement 34 may be retarded somewhat to align cure rate with the deployment of the member 38. The radially extendable member 38 establishes essentially a cement free pathway from the interior 46 of the tubular 18 through the ports 22 and through the radially extendable member 38 to the earth formation 14.

Once the cement 34 has at least substantially cured in the unmasked areas (the areas not containing the deployed members 38), the system 10 is activated to move sleeves 48 and expose the ports 22 through a series of ball drops. As shown in FIG. 5, fracturing operations can begin from the pressure activated toe-sleeve by pressuring up the system 10 to open the sleeve 48. In one exemplary embodiment, fracturing can be preceded by pumping an agent 50 that attacks the swellable elastomer in the area surrounding the outer diameter of the now-open pressure activated sleeve 48. Swelling elastomer attacking agent 50 may be pumped at the lead of each stage intended to undermine the strength of the member 38. Treating the members 38 with the agent 50 has the effect of maximizing the area available to flow for fracturing treatment and limiting tortuosity, while maintaining the integrity advantages of a cemented liner. Exemplary embodiments of an agent 50 to degrade the member 38 formed of water swell rubber include a solvent/acid blend, such as, but not limited to toluene or dimethyldisulfide ("DMDS")/HCl or $HNO_3$. If the member 38 is formed of oil swell rubber, or a combination of oil/water swell materials, a more aggressive hydrocarbon solvent may be employed as the agent 50, such as, but not limited to, xylene, toluene or a mutual solvent such as DMDS. When introduced prior to curing of the elastomer material in the member 38, the agent 50 will degrade the material enough to allow a relatively unhindered flow of frac fluid. In alternative embodiments, the agent 50 may not be necessary as the force to penetrate through the swelling elastomer is much less than that required of cement, and the force of fracturing fluids may be sufficient.

FIG. 5 demonstrates one exemplary embodiment for opening the sleeve 48, which includes the landing of a plug, such as a ball 52, on a ball seat 54. Seating the ball 52 allows pressure built against the ball 52 to move the ball 52, ball seat 54 and attached sliding sleeve 48 in a downhole direction 40. Movement of the sliding sleeve 48 in the downhole direction 40 reveals the ports 22 and the deployed member 38, which are otherwise sealed from the interior 46 of the tubular 18 via seals 58, 60 (FIG. 4) that seal the sleeve 48 relative to the wall 20 of the tubular 18. That is, once the sliding sleeve 48 is moved, the interior 46 of the tubular 18 is fluidically connected to the ports 22 and deployed member 38. The sliding sleeve 48 may include ports (not shown) that are misaligned with ports 22 in the tubular 18 in a non-activated condition of the sleeve 48, and aligned with the ports 22 in the tubular 18 when the sliding sleeve 48 is moved into an open condition of the ports 22. Alternatively, the sliding sleeve 48 may be imperforate and moved completely away from the ports 22 in the tubular 18 to provide direct access between the interior 46 of the tubular 18 and the members 38.

Once the cement 34 has cured, the result is a substantially cemented completion system 10 with a cement sheath that is absent or severely compromised in the areas adjacent to any of the flow ports 22 as a result of the deployment of the member or members 38. FIG. 6 demonstrates an embodiment where the agent 50 has degraded the member 38 to a point where it is substantially removed from a radial area 51 accessible from the ports 22 and exposed by the displaced sleeve 48. Whether the member 38 is present in the area 51 or not, pump rate can increase and the first fracture stage can be completed via delivery of a fracturing fluid which may contain proppant. The ports 22 can be divided up into one or more zones, with just a single one of the zones being illustrated herein and the sliding sleeves 48 prevent simultaneous pressuring up of all zones located along the system 10. Subsequent stages can be completed by dropping the appropriate ball size and landing the ball 52 while pumping more of the agent 50, if used, and the fracture treatment will follow with the pattern continuing until all sleeves 48 are opened. In this manner all of the stages in the system 10 benefit from the large flow area unfettered by tortuous perforation tunnels or cement, yet most of the completion is cemented in place, maximizing wellbore integrity.

Removal of the member 38, whether via the agent 50 or other treatments which chemically and/or mechanically remove the member 50, allows fluidic communication between an interior 46 of the tubular 18 and the earth formation 14. This fluid communication allows treating of the formation 14. Such treatments include fracturing, pumping proppant and acid treating, for example. Additionally, the system 10 would allow for production of fluids, such as hydrocarbons, for example, from the formation 14. The system 10 enables the use of pre-formed ports 22 within the tubular 18, as opposed to perforating the tubular 18 with perforations while within the borehole 12. Thus, perforating guns are not required.

While FIGS. 1-6 depict the downhole system 10 in conjunction with a ball-activated sleeve 48, it should be understood that the system is also usable with other types of frac sleeves 56 (see FIG. 7), such as, but not limited to, pressure actuated sleeves, hydraulically actuated sleeves, electrically actuated sleeves, and sleeves operable by downhole tools such as wireline devices, shifting tools, and bottom hole assemblies. An exemplary sleeve 56 not actuated by a ball 52 is shown in FIG. 7 with the member 138 in a non-swelled condition. With the exception of the sleeve 56 being movable by a means other than the ball 52, the system 100 shown in FIG. 7 may be operated in a manner similar to the system 10 shown in FIGS. 1-6.

Thus, FIGS. 1-8 disclose a cemented progressive fracturing system suitable for horizontal wells that feature swelling elastomer mounted on the outer diameter of ported equipment. The swelling elastomer is positioned and formulated so that after run-in, the elastomer swells from the outer diameter of completion to the inner diameter of the borehole 12, creating seemingly isolated sections of the wellbore. Additionally, the swelling elastomer members 38 feature shunt tubes 70 that are embedded such that they "connect" isolated sections of the formation/completion annulus. These shunt tubes 70 are intended to allow uncured cement 34 to flow from one section of the annulus 36 to another during primary cementing operations, yet also maintain an appreciable area of the annulus 36 adjacent to ported equipment free of cement, due to the isolation provided by the swelling elastomer members 38. In an exemplary embodiment of the system 10, swelling elastomer members 38 with shunted cemented bypass would be applied on all sliding sleeves as well as the P-sleeve or alpha sleeve at the toe of the completion.

Therefore, a method and apparatus for progressive fracturing has been described using swelling elastomers as a means to keep cement out of undesirable areas during cementing operations. The system incorporates swelling elastomers as radially extendable members, and further features an additional integral conduit enabling cement flow-through.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A cement masking system comprising:

a tubular having a wall with at least one radial port formed as an aperture through the wall; and, at least one swellable member arranged to cover an interior of the aperture of the at least one port and block, in a radial direction, the interior of the aperture of the at least one port from an area exterior of the aperture;

wherein the at least one swellable member is configured to expand in a radial direction from the aperture and displace cement radially of the tubular during radial expansion of the at least one swellable member, the at least one swellable member expandable by absorbing a liquid between the wall of the tubular and a wall of a borehole, and the swellable member swelling upon contact with the cement.

2. The cement masking system of claim 1 wherein the at least one swellable member surrounds an outer diameter of the tubular.

3. The cement masking system of claim 1, wherein the at least one swellable member is a swellable elastomer.

4. The cement masking system of claim 1, further comprising a swell member attacking agent introduced through the tubular and through the aperture of the at least one port, the swell member attacking agent degrading a material of the at least one swellable member positioned radially of the aperture of the at least one port.

5. The cement masking system of claim 1, further comprising at least one sleeve engaged to slide within the tubular to prevent fluid communication between an interior of the tubular and the at least one port until the at least one sleeve has been moved.

6. The cement masking system of claim 1, wherein one of the at least one swellable member covers a plurality of ports in the tubular.

7. The cement masking system of claim 1, further comprising the cement disposed around the tubular and displaced from an area radially outward of the aperture of the at least one port by the at least one swellable member.

8. The cement masking system of claim 1, wherein the at least one swellable member is disposed within the interior of the aperture of the at least one port.

9. A cement masking system comprising:

a tubular having a wall with at least one radial port formed as an aperture through the wall;

at least one swellable member arranged to cover an interior of the aperture of the at least one port and block, in a radial direction, the interior of the aperture of the at least one port from an area exterior of the aperture, the at least one swellable member configured to expand in a radial direction from the aperture and displace cement radially of the tubular during radial expansion of the at least one swellable member; and, at least one shunt tube configured to allow passage of cement from one side of the at least one swellable member to a longitudinally opposite side of the at least one swellable member.

10. The cement masking system of claim 9, wherein the at least one shunt tube includes a plurality of shunt tubes passing through one of the at least one swellable member.

11. The cement masking system of claim 9, wherein one of the at least one shunt tube is positioned between a pair of adjacent ports among the at least one port.

12. The cement masking system of claim 9 wherein the at least one shunt tube is positioned radially inward of at least a portion of the at least one swellable member.

13. The cement masking system of claim 9 wherein the at least one shunt tube is rigidly secured to the wall of the tubular.

14. The cement masking system of claim 9 wherein the at least one shunt tube has a longitudinal length that is longer than a longitudinal length of the at least one swellable member.

15. A method of masking apertures in a wall of a tubular from cement, the method comprising:

covering an interior of the apertures by at least one swellable member and blocking, in a radial direction, the interior of the apertures from an area exterior of the apertures;

inserting the tubular within a borehole;

cementing an annular space between the tubular and the borehole;

allowing the swellable member to expand from liquid within the annular space and expand radially from the apertures; and, displacing the cement with the swellable member as the swellable member expands by absorbing the liquid in the annular space.

16. The method of claim 15, wherein allowing the swellable member to expand from liquid within the annular space includes allowing the swellable member to expand from liquid in the cement.

17. The method of claim 15, further comprising allowing the cement to flow past the at least one swellable member through at least one shunt tube.

18. The method of claim 17, wherein the at least one shunt tube is longer than the at least one swellable member in an expanded condition of the at least one swellable member.

19. The method of claim 15, further comprising performing a fracturing operation through the apertures and the swellable member.

20. The method of claim 15, further comprising introducing a swell member attacking agent through the tubular, at least partially degrading a material of the at least one swellable member positioned radially of the apertures with the swell member attacking agent, and subsequently performing a fracturing operation through the apertures.

21. A method of masking ports in a tubular from cement, the method comprising:

covering the ports by at least one swellable member;

inserting the tubular within a borehole;

cementing an annular space between the tubular and the borehole;

allowing the swellable member to expand from liquid within the annular space;

displacing the cement with the swellable member as the swellable member expands by absorbing the liquid in the annular space; and, introducing a swell member attacking agent through the tubular, at least partially degrading a material of the at least one swellable member with the swell member attacking agent, and subsequently performing a fracturing operation through the ports;

wherein introducing the swell member attacking agent through the tubular includes introducing the swell member attacking agent prior to curing of the at least one swellable member.

22. The method of claim 15, further comprising initially preventing fluid communication between an interior of the tubular and the apertures, and establishing fluid communication via moving a sleeve.

* * * * *